US006173544B1

(12) United States Patent
Spanjers

(10) Patent No.: US 6,173,544 B1
(45) Date of Patent: Jan. 16, 2001

(54) CEILING SYSTEM AND ALSO A LATH SUITABLE FOR SUCH A CEILING SYSTEM

(76) Inventor: Joseph Spanjers, Kopeheupel 17, 5685, BA Best (NL)

( * ) Notice: Under 35 U.S.C. 154(b), the term of this patent shall be extended for 0 days.

(21) Appl. No.: 09/194,047

(22) PCT Filed: May 16, 1997

(86) PCT No.: PCT/NL97/00274

§ 371 Date: Nov. 19, 1998

§ 102(e) Date: Nov. 19, 1998

(87) PCT Pub. No.: WO97/44546

PCT Pub. Date: Nov. 27, 1997

(30) Foreign Application Priority Data

May 20, 1996 (NL) ..... 1003163

(51) Int. Cl.[7] ..... E04B 9/22

(52) U.S. Cl. ..... 52/222; 52/223.1; 52/506.08; 52/718.05; 52/733.1

(58) Field of Search ..... 52/39, 63, 222, 52/223.1, 506.06, 506.08, 506.09, 506.1, 718.02, 718.05, 730.1, 733.1

(56) References Cited

U.S. PATENT DOCUMENTS 4,333,284 * 6/1982 Meadows ..... 52/222
4,644,706 * 2/1987 Stafford et al. ..... 52/63
4,763,452 * 8/1988 Harvey ..... 52/222 X
4,788,806 12/1988 Sease .
4,986,332 * 1/1991 Lanuza ..... 52/222 X
5,029,422 * 7/1991 Scherrer ..... 52/222
5,535,560 * 7/1996 Fligg ..... 52/222

FOREIGN PATENT DOCUMENTS 35 30 251 3/1987 (DE) .
2 175 855 10/1973 (FR) .
2 524 922 10/1983 (FR) .
2 597 906 10/1987 (FR) .
2 721 051 12/1995 (FR) .
7 302 059 8/1973 (NL) .

* cited by examiner

*Primary Examiner*—Carl D. Friedman
*Assistant Examiner*—Kevin D. Wilkens
(74) *Attorney, Agent, or Firm*—Skjerven Morrill MacPherson LLP

(57) ABSTRACT

A ceiling system for attachment to an existing ceiling. The system comprises a plurality of laths, each lath mounted to an existing ceiling, wherein each lath is provided with at least a first slot and a second slot, the second slot parallel to the first slot; a cloth stretched between the laths, wherein the cloth is detachably fixed in the first slot by a strip clamped down therein, and a cover mould having a rib, the rib detachably clamped down in the second slot, the cover mould extending beyond the strip positioned in the first slot.

5 Claims, 1 Drawing Sheet

CEILING SYSTEM AND ALSO A LATH SUITABLE FOR SUCH A CEILING SYSTEM

The invention relates to a ceiling system comprising at least two laths to be fixed some distance apart and a cloth to be stretched between said laths.

The invention furthermore relates to a lath suitable for such a ceiling system.

A ceiling system of this kind is used for finishing a ceiling in whole or in part. Of course it is also possible to use the ceiling system for finishing walls.

With a ceiling system which is known per se, laths are fixed to the ceiling. Then a cloth is fixed to the laths by means of staples. Thus a ceiling can be finished in a simple manner, whereby the ceiling is hidden from view by the cloth. The colour and the structure of the cloth thus provide a possibility to change the appearance of the ceiling in a simple manner.

The use of staples makes the provision of the cloth a relatively time-consuming operation, whilst the permanent fastening by means of the staples makes the original ceiling inaccessible.

With another ceiling system which is known per se, laths are provided with slots, in which the cloth is clamped down, after which finishing moulds are fixed to the laths by means of screws or nails. Also with this known ceiling system the original ceiling is no longer accessible.

The object of the invention is to provide a ceiling system wherein the above drawbacks are avoided.

This objective is accomplished with the ceiling system according to the invention in that each lath is provided with at least two parallel slots, whereby the cloth can be detachably fixed in the first slot by means of a strip which can be clamped down in said slot, whilst a rib extending transversely to a cover mould can be detachably clamped down in said second slot, said cover mould extending beyond the strip positioned in said first slot.

The cloth can be fixed to the lath relatively quickly by means of said strip, whereby access to the original ceiling can be readily gained by removing said cover mould and said strip. This is of importance, for example when suspending a lamp from the original ceiling. The lath can be beautifully finished in a simple manner by means of said cover mould, whereby the strip, by means of which the cloth is fitted, is hidden from view by said cover mould. Preferably said cover mould extends over the entire lath. It is noted that French patent document No. 2,597,906 discloses a ceiling system whereby each edge of the cloth is provided with attachment means which can be connected to an upwardly and inwardly extending flange of a lath. A cover mould provided with a rib can be clamped between two adjacent attachment means. A disadvantage of this system is that the stretching of the cloth depends on the position of the attachment means with respect to the edge of the cloth. Furthermore the positioning of the rib between the two attachment means might be cumbersome as in case that the distance between the two attachment means is too wide the rib will not be held and in case that the distance is too small the insertion of the rib between the attachment means might cause the attachment means to come loose from the lath and the cloth will be detached therefrom. It is noted that ceiling systems are known from U.S. Pat. No. 4,788,806, and Netherlands patent document No. 7,302,059. Said ceiling systems are not provided with a cover mould, however.

One embodiment of the ceiling system according to the invention is characterized in that said lath is furthermore provided with a third slot extending between said first and said second slot.

When in the case of a relatively large ceiling two cloths are used, which extend on either side of the lath, said cloths are clamped down in said first slot and said second slot by means of strips. Then the cover mould is fixed in said third slot extending between said cloths by clamping the rib extending transversely to said cover mould down in said slot.

Another embodiment of the ceiling system according to the invention is characterized in that said lath comprises a hook-shaped guide section, which extends parallel to said slots, whereby an attachment block is slidably accommodated in said guide section.

When the laths are fixed to a ceiling or to walls, the guide sections face towards the wall. Pictures or the like can be suspended from said attachment blocks by means of wires. In this manner a ceiling system is obtained whereby the number of parts to be fixed to the ceiling or to the walls is minimal.

The invention will be explained in more detail with reference to the drawing, in which.

Like parts are numbered alike in the Figures.

Figures 1, 2:
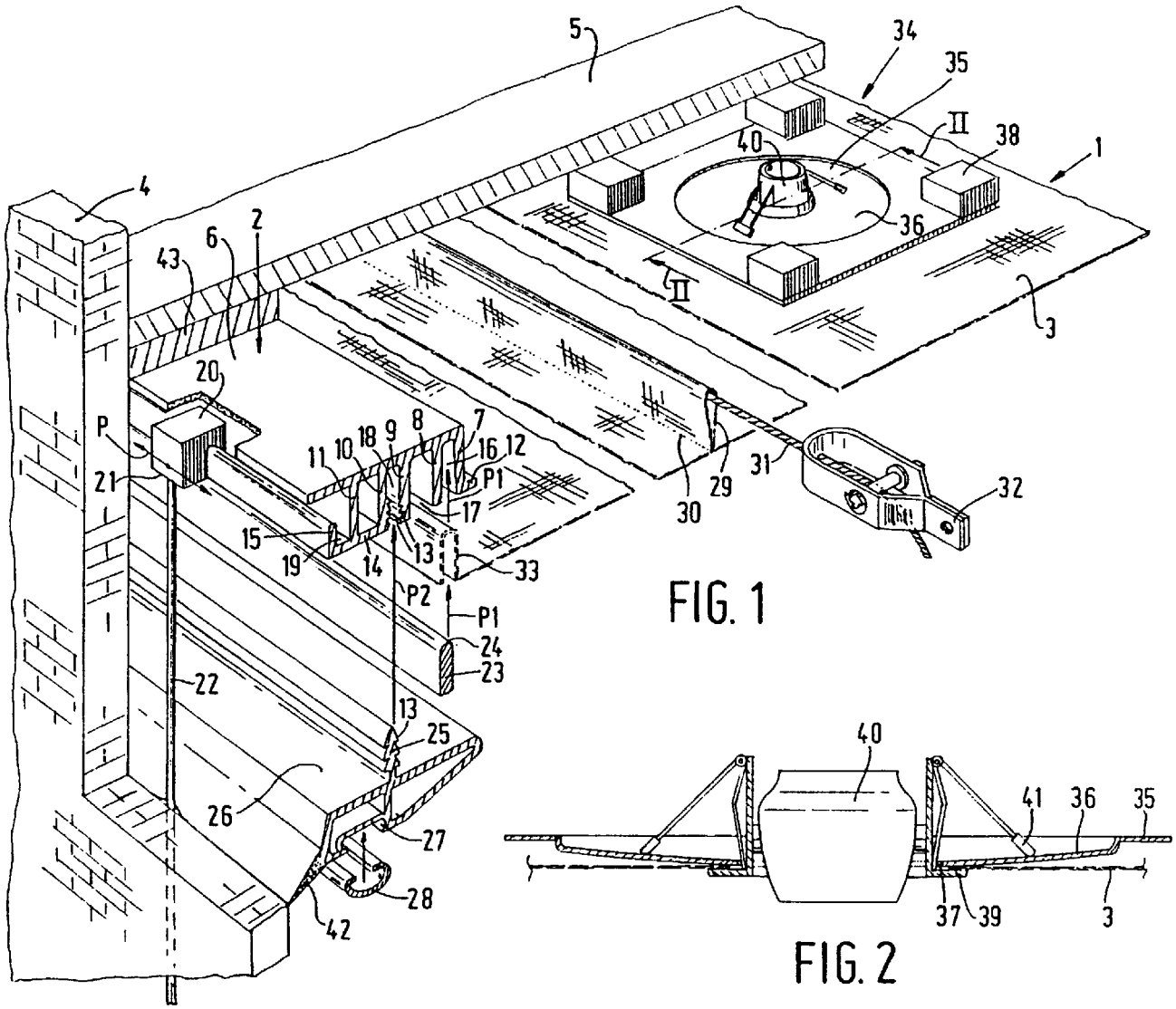
FIG. 1 is a perspective view of a ceiling system according to the invention.
FIG. 2 is a cross-sectional view of a lamp attachment with a ceiling system according to the invention, taken along line II—II of FIG. 1.

FIG. 1 shows a ceiling system 1 according to the invention, which comprises a number of laths 2 extending parallel to each other and transversely to each other, and a flexible cloth 3 of plastic material, which is stretched between said laths. For the sake of clarity only one lath 2 is shown in FIG. 1, but it will be apparent that other laths may be disposed in parallel or transverse relationship thereto.

Ceiling system 1 functions as the finishing element of a ceiling 5 extending between walls 4, whereby the ceiling is finished in whole or in part. Before describing the attachment of ceiling system 1 to ceiling 5, the individual parts of ceiling system 1 will be explained first. Lath 2 is an elongated section having a length of for example 2 m, which may be extruded from plastic material or from aluminium, for example, and which comprises a baseplate 6 and five walls 7, 8, 9, 10, 11 extending transversely thereto. Wall 7 comprises a flange 12 extending transversely to said wall near one end thereof. Walls 9 and 10 comprise barb-like teeth 13 on their sides facing each other. On their sides facing away from baseplate 6, walls 10 and 11 are interconnected by means of a plate 14 extending parallel to baseplate 6, beyond wall 11, which plate 14 is provided at one end with a flange 15 facing baseplate 6. The open walls 7, 8, 9, 10 form three slots 16, 17, 18 extending parallel to each other.

Baseplate 6, upright wall 11, part of plate 14 and flange 15 extending transversely thereto together form a hook-shaped guide section 19, in which a U-shaped attachment block 20 is slidably accommodated. Attachment block 20 may move along line P as shown by the arrows. One leg 21 of U-shaped attachment block 20 is positioned outside guide section 19. A cord 22 is secured to said leg 21.

An elongated strip 23 can be clamped down in first slot 16, said strip comprising a rounded part 24 on a side facing lath 2.

A rib 25, which is likewise provided with barbs, can be clamped down in barbed second slot 18. Rib 25 extends transversely to a cover mould 26, whose width is at least equal to the width of lath 2. Cover mould 26, which may for example be extruded from plastic material or from aluminium, is provided with a groove 27 on a side facing away from said rib, in which groove an ornamental strip 28 can be detachably fixed. Cover mould 26 is provided with an elastically deformable flange 42 on a side facing wall 4.

Cloth 3 is provided with a number of parallel loops 29, only one of which is shown in FIG. 1. Loop 29 is formed by folding cloth 3 double locally and fixing the opposite cloth parts together by means of a welded or stitched seam 30. Loop 29 accommodates a tensioning cable 31, which is provided with a tensioning element 32 at both ends.

The attachment of ceiling system 1 to a ceiling 5 will now be explained in more detail.

First distance blocks 43 are fixed to ceiling 5 near walls 4. Then holes are drilled in plates 14 between walls 10, 11, through which screws are passed. Then baseplate 6 is fixed to distance blocks 43 by means of said screws. Laths 2 are connected together by means of mitre joints near the place where walls 4 join each other. After ceiling 5 has been provided with laths 2 near all walls 4 bounding the ceiling, the provision of cloth 3 may be started. To this end cloth 3 is placed opposite first slot 16 and clamped down therein by moving strip 23 in the direction indicated by arrow P1, engaging the cloth 3 at position 33. Cloth 3 is formed into a U-shape thereby. When cloth 3 is relatively large, it will be provided with loops 29, in which tensioning cables 31 are accommodated. The tensioning elements 32 secured to the ends of said tensioning cables are fixed to walls 4 between laths 2 and ceiling 5 by means of a bracket (not shown). Then cloth 3 is stretched by means of tensioning elements 32. This prevents cloth 3 from sagging in the middle. All edges of cloth 3 are then connected to laths 2 by means of strips 23. Cloth 3 is tensioned along all edges by pressing cloth 3 into slot 16. Then cover mould 26 is moved in the direction indicated by arrow P2, whereby rib 25 is slid into slot 18. Barbs 13 provide a solid connection between lath 2 and cover mould 26. As a result of said cover mould being provided, lath 2 and strip 23 are hidden from view and an attractive finish of the ceiling near wall 4 is obtained. In order to make cover mould 26 look even more attractive an ornamental strip 28 is fitted into groove 27. It will be readily possible to replace said ornamental strip 28 by another ornamental strip, if desired. In the abovedescribed manner the ceiling system 1 according to the invention can be fixed to a ceiling 5 relatively quickly. Elastic flange 42 abuts against wall 4 and adapts itself to local unevennesses on wall 4 by elastic deformation. Elastic flange 42 furthermore enables easy passage of cord 22. Cord 22 may subsequently be used for suspending a painting or the like therefrom.

In the case of a relatively large ceiling or a transition between two ceilings it is also possible to fix a lath 2 to the ceiling at some distance from walls 4. In that case a cloth is stretched on either side of lath 2, whereby cloths 3 are secured both within first groove 16 and within second groove 18 by means of strips 23. Then a cover mould is attached to lath 2 by sliding rib 25 into the middle or third groove 17. The cover mould has a symmetric configuration thereby, and does not comprise an elastically deformable flange 42.

FIG. 2 shows a ceiling system according to the invention composing a lamp mounting element 34. Lamp mounting element 34 comprises a square plate 35, which is centrally provided with an indentation 36. Said indentation 36 is provided with a hole 37 in its centre. Plate 35 is provided with four attachment blocks 38 near its corner points, which are fixed to the ceiling by means of screws prior to the cloth being provided. After cloth 3 has been provided, a hole 39 is formed in cloth 3, opposite hole 37. Then a lamp system 40, which is known per se, is mounted on plate 35 by means of springs 41 through opposite holes

What is claimed is:

1. A ceiling system comprising:

a plurality of laths fixed relative to a ceiling and spaced some distance apart wherein each lath is provided with at least a first slot and a second slot, said second slot parallel to said first slot;

a cloth stretched between said laths, wherein said cloth is provided with a loop on a side facing said laths, which loop accommodates a tensioning cable, and further wherein said cloth is detachably fixed in each said first slot by means of a strip clamped down therein; and at least one cover mould, each cover mould having a rib, each rib detachably clamped down in a respective said second slot, each cover mould extending beyond said strip clamped down in the corresponding said first slot.

2. A ceiling system comprising:

a plurality of laths fixed relative to a ceiling and spaced some distance apart wherein each lath is provided with at least a first slot and a second slot, said second slot parallel to said first slot;

a cloth stretched between said laths, wherein said cloth is detachably fixed in each said first slot by means of a strip clamped down therein; and at least one cover mould, each cover mould having a rib, each rib detachably clamped down in a respective said second slot, each cover mould extending beyond said strip clamped down in the corresponding said first slot, wherein each cover mould is provided, on a side facing away from said rib, with an ornamental strip which is detachably fixed thereto.

3. A ceiling system comprising:

a plurality of laths fixed relative to a ceiling and spaced some distance apart wherein each lath is provided with at least a first slot and a second slot, said second slot parallel to said first slot;

a cloth stretched between said laths, wherein said cloth is detachably fixed in each said first slot by means of a strip clamped down therein; and at least one cover mould, each cover mould having a rib, each rib detachably clamped down in a respective said second slot, each cover mould extending beyond said strip clam-ped down in the corresponding said first slot, wherein each cover mould is provided, on a side facing away from said rib, with an elastically deformable flange, and further provided, on a side facing away from said rib, with an ornamental strip which is detachably fixed thereto.

4. A ceiling system comprising:

a plurality of laths fixed relative to a ceiling and spaced some distance apart wherein each lath is provided with at least a first slot and a second slot, said second slot parallel to said first slot, wherein said laths each comprise a hook-shaped guide section, which extends parallel to said slots, whereby an attachment block is slidably accommodated within said guide section;

a cloth stretched between said laths, wherein said cloth is detachably fixed in each said first slot by means of a strip clamped down therein; and at least one cover mould, each cover mould having a rib, each rib detachably clamped down in a respective said second slot, each cover mould extending beyond said strip clamped down in the corresponding said first slot.

5. A ceiling system comprising:

a plurality of laths fixed relative to a ceiling and spaced some distance apart wherein each lath is provided with at least a first slot, a second slot, and a third slot, said second slot parallel to said first slot, said third slot extending between said first and said second slot, wherein said laths each comprise a hook-shaped guide section, which extends parallel to said slots, whereby an attachment block is slidably accommodated within said guide section;

a cloth stretched between said laths, wherein said cloth is detachably fixed in each said first slot by means of a strip clamped down therein; and at least one cover mould, each cover mould having a rib, each rib detachably clamped down in a respective said second slot, each cover mould extending beyond said strip clamped down in the corresponding said first slot.

* * * * *